US007374043B2

(12) United States Patent
Holley, Jr. et al.

(10) Patent No.: US 7,374,043 B2
(45) Date of Patent: May 20, 2008

(54) CARTON WITH SIDE ACCESSIBLE DISPENSER

(75) Inventors: John M. Holley, Jr., Lawrenceville, GA (US); Aaron Bates, Powder Springs, GA (US)

(73) Assignee: Mead Westvaco Packaging Systems, LLC, Glen Allen, VA (US)

( * ) Notice: Subject to any disclaimer, the term of this patent is extended or adjusted under 35 U.S.C. 154(b) by 288 days.

(21) Appl. No.: 11/250,987

(22) Filed: Oct. 14, 2005

(65) Prior Publication Data

US 2006/0081492 A1 Apr. 20, 2006

Related U.S. Application Data

(60) Provisional application No. 60/619,435, filed on Oct. 14, 2004.

(51) Int. Cl.

| | |
|---|---|
| ***B65D 75/00*** | (2006.01) |
| ***B65D 5/72*** | (2006.01) |
| ***B65D 17/28*** | (2006.01) |
| ***A47F 1/04*** | (2006.01) |

(52) U.S. Cl. ..... 206/427; 221/305; 221/309; 229/122; 229/240

(58) Field of Classification Search ..... 206/427; 221/302, 305, 309; 229/122, 122.1, 240–242
See application file for complete search history.

(56) References Cited

U.S. PATENT DOCUMENTS

| | | | | |
|---|---|---|---|---|
| 3,237,837 | A * | 3/1966 | Vizethann | 229/240 |
| 5,368,194 | A | 11/1994 | Oliff | |
| 6,478,219 | B1 | 11/2002 | Holley, Jr. | |
| 6,669,083 | B2 * | 12/2003 | Bates | 229/240 |
| 6,997,316 | B2 * | 2/2006 | Sutherland | 206/427 |
| 7,000,803 | B2 * | 2/2006 | Miller | 221/302 |
| 7,073,665 | B2 * | 7/2006 | Auclair et al. | 206/427 |

* cited by examiner

*Primary Examiner*—Bryon P Gehman
(74) *Attorney, Agent, or Firm*—Parks Knowlton LLC

(57) ABSTRACT

A carton with an improved dispenser facilitates access to articles enclosed within by providing expansive side recesses that expose at least one article on the lowermost row and the two end most articles in the uppermost row. The dispenser opening is defined by one or more severance lines extending at least partially across the top, end, and side walls, with a portion of the end wall remaining as an article stopper after the at least partially detachable portion of the dispenser is removed.

13 Claims, 4 Drawing Sheets

100

102
104
106
108
110
112
114
116
118
120a
120b
122a
122b
124a
124b
126a
126b
128a
128b
130a
130b
132a
132b
134a
134b
136a
136b
138a
138b
140
142
143
144
148
150
152
154
156
158
160
H

CARTON WITH SIDE ACCESSIBLE DISPENSER

CROSS-REFERENCE TO RELATED APPLICATIONS

This application claims priority to co-pending U.S. Provisional Application No. 60/619,435, filed on Oct. 14, 2004, which is entirely incorporated herein by reference.

TECHNICAL FIELD

This invention relates generally to cartons for packaging multiple articles such as beverage cans or bottles, and more particularly, to a carton with a side accessible article dispenser that improves access to the articles contained therein.

BACKGROUND OF THE INVENTION

Cartons for encasing and dispensing multiple articles such as soft drink cans or bottles are useful for enabling users to transport, store, and access the articles for consumption. The user typically prefers the ability to easily retrieve one article from the carton at a time. To that end, it is desirable to have cartons with dispensers which allow one article to be removed, while continuing to encase the remaining articles. The user tears out a portion of the carton to form an access opening from which articles may be dispensed.

When the articles contained in the carton are cylindrical, and are disposed in the carton upon their sides, it is important that the articles be constrained such that the remaining articles do not unexpectedly and undesirably roll out of the dispenser when one is removed. It is also important to restrain all of the articles such that when the carton is first opened, the first article does not fall out of the carton. Thus, it can be appreciated that it would be desirable to have a carton with a dispenser that constrains articles to prevent the articles from undesirably rolling from or otherwise exiting the carton when one article is removed, or when the carton is first opened.

As a carton may be stored in a restrictive space such as on a refrigerator shelf, it is advisable to provide an access opening that enables a user to access an end of an article to pull the article out of the carton end rather than having to lift the article out of the top of the carton. End removal of articles is especially advantageous where the carton is to be stored on an adjustable refrigerator shelf, because the user is able to optimize storage space by conforming the height of the shelf to the height of the carton, without obscuring the access opening.

It is known to provide a carton having a side accessible dispenser for articles, such as those shown in U.S. Pat. Nos. 5,368,194 and 6,478,219. Advantageously, these cartons enable the user to access the end of an article through a side wall portion of an access opening, and to "hook" the end of the article with one or more fingers to pivot the end of the article toward and through the end wall portion of the access opening, such that the article can then be removed from the carton through the end wall. However, the access opening created by removal of a tear panel of each of these inventions is situated near the bottom wall of the respective cartons, and thus, the dispenser of each of the cartons of these inventions must have a relatively small opening to prevent the lowermost article from falling out of or being ejected from the carton. The small opening dictates that the user must manipulate the endmost article into the correct position for removal from the carton, thereby potentially tearing the access opening. Furthermore, the lowermost article within each carton may tend to be forced toward the opening due to gravity and pressure from other articles in the carton such that the lowermost article undesirably at least partially protrudes through the opening before the user actually attempts to remove the article. When the lowermost article is removed, the same forces may cause another article to rapidly and somewhat forcefully shift toward the opening, which may tear the access opening and compromise the integrity of the carton and of the opening, which tends to further degrade the ability of the opening to restrain the articles remaining in the carton.

It can be appreciated, therefore, that it also is desirable to provide a carton having an improved article dispenser that is convenient to use and facilitates access to and removal of articles.

SUMMARY OF THE INVENTION

The present invention with its various embodiments overcomes the shortcomings of the prior art by providing a dispenser having an access opening for accessing an end of an article to remove the article from an end wall of the carton, the access opening being sufficiently large to eliminate the need for extensive manipulation of the article, and the access opening being dimensioned such that at least part of its periphery serves as a reliable article stopper to prevent the articles from spontaneously rolling out of the carton through the access opening.

More specifically, according to each of the various embodiments of the invention, a carton is provided for enclosing two or more rows of horizontally disposed cylindrical articles, the carton having a dispenser defined by the removal of a tear panel. The dimensions, contours, and orientation of the dispenser allow a user to secure a handhold on one of the exposed ends of the endmost article on the upper row of the carton. The dimensions of the carton dispenser are also sufficient for a user to secure a handhold on an exposed end of the endmost article on the lower row of the carton to remove the endmost article from lower row after some or all of the articles in the upper row have been removed. Furthermore, the periphery of the carton dispenser defines a means for securely retaining the articles in the carton.

Generally described, the invention provides a carton comprising a top wall, a pair of opposed side walls connected to opposing side edges of the top wall, an end wall interconnecting the side walls, a bottom wall interconnecting respective lower edges of the side walls and said end walls, and an article dispenser including a removable tear panel disposed substantially at an end of the carton. The tear panel is defined by severance lines formed in one of the side walls (which is hereinafter referred to as the "side access wall") and in an end wall.

The severance line in the side access wall defines a recess upon removal of the tear panel. In certain embodiments, the side wall recess is defined by a side wall severance line that is essentially V-shaped, the side wall severance line extending from the top wall and partially down the side access wall at an angle that disposes a portion of the side wall severance line across an end of the endmost article on the upper row of the carton, and turns relatively sharply to extend toward the end wall at an angle that disposes another portion of the side wall severance line across an end of the endmost article on the lower row of the carton. In the embodiments described, the side wall severance line begins at a corner comprising the intersection of the top wall, an end wall, and the side access wall, and the side wall severance line terminates at the hingedly connecting edge between the side access wall and the end wall. The greatest distance between the side wall severance line and the adjacent end wall is at least as great as the diameter of one cylindrical article. The point on the side wall severance line that is furthest from the end wall is disposed between the four endmost articles in a full carton according to the invention, and preferably comprises a tear initiation means such as push tab.

According to another aspect of the invention, the side wall severance line extends from the end wall to the furthest point along its recessed section and extends without crossing over itself from the furthest point to the end wall to be continuous with one or more end wall severance lines.

The severance lines in the end wall define a stopper wall for preventing the endmost article in the lowermost row of carton from rolling out of the carton and for restraining a first end of the endmost article in the uppermost row of the carton. Another portion of the end wall that remains after removal of the tear panel comprises an articulable stopper flap for variably and reversibly reconfiguring the dimensions of the access opening to permit selective restraint or removal of the endmost article on the upper row. The stopper flap preferably includes a curved edge adjacent to the side access wall that facilitates access to the first end of the endmost article on the upper row for removal of the article. The opposite edge of the stopper flap adjacent to the other side wall cooperates with a portion of the stopper wall to restrain a second end of the endmost article of the endmost article on the upper row of the carton.

According to one aspect of the invention, the height of the stopper flap, as defined by the distance from the top wall of the carton to the distal edge of the stopper flap, is no greater than the diameter of an article, but is sufficient to restrain an article on the upper row.

According to another aspect of the invention, the side wall recess has sufficient area to expose a portion of the edges of the ends of the endmost article on the upper row and of the endmost article on the lower row, while restraining the ends of the article from exiting through the side of the carton.

According to yet another aspect of the invention, a portion of the stopper wall has a height, which is measured from the bottom wall, which is less than the diameter of an article, but is sufficient to prevent the endmost article on the lower row from rolling out of the carton.

According to yet another aspect of the invention, the side wall severance line and the one or more end wall severance lines are segments of a single frangible line that defines at least one detachable tear panel that can be separately detached from the carton to define the opening for dispensing articles within the carton. The frangible line may comprise any known or yet to be developed severance means, such as a severance line weakened by perforations, cuts, or half-cuts to facilitate tearing or breaking along the frangible line. As an alternative or supplement, a tear tape may be embedded or attached along the frangible line.

Another aspect of the invention provides a package comprising an article group formed of at least two vertically arranged rows or tiers of similarly dimensioned, cylindrical articles disposed on their sides in a side-by-side parallel fashion, and a carton disposed around the article group. The carton comprises a plurality of walls including a top wall, a pair of opposed side walls connected to the opposed side edges of the top wall, an end wall interconnecting the side walls, a bottom wall interconnecting the respective lower edges of the side walls and an article dispenser for dispensing the articles from the carton. The dispenser includes a removable tear panel of the carton formed from one of the side walls (the "side access wall") and from the adjacent end wall. The tear panel is detachably connected to the side access wall and the end wall along a detachable connection, and is to be removed from the carton thereby defining an access opening for exposing at least some of the articles for removal. The access opening is shaped to define a recess in the side access wall to reveal a portion of the end of each of the endmost articles in the upper and lower rows of the article group.

The detachable connection comprises severance lines for defining the edge of the access opening. The severance lines are formed respectively in the side access wall and the end wall, and the severance line in the side access wall comprises a recessed section.

The recessed section of the side wall severance line comes to a point, which may be generalized, blunt, or inexact, such that the recessed section is at least generally V-shaped, optionally with one or both sides of the V being curved, and with the sides of the V being either asymmetrical or symmetrical. Preferably, the side wall severance line is disposed across one end of each of the endmost articles in the upper and lower rows of the carton.

In certain embodiments, the lowest point of the side wall severance line as defined as the shortest distance between the side wall severance line and the bottom wall is less than the diameter of each article.

According to an aspect of the invention, the one or more severance lines in the end wall extend continuously from an end of the side wall severance line to define an upper edge of a stopper wall. The lowest point on the upper edge of the stopper wall is common to the lowest point of the side wall severance line. The highest point along the upper edge of the stopper wall preferably has a distance from the bottom wall that is substantially equal to the height of the carton; thus, the maximum height of the stopper wall is equal to the height of the carton. The highest point along the upper edge of the stopper wall is adjacent to the side wall opposite the side access wall. The stopper wall overlaps the stopper flap over a distance equal to up to three quarters of the width of the end wall as measured along the end edge of the top wall. The maximum width of the stopper flap is preferably substantially equal to the interior width of the end wall, which is at least slightly wider than the height of one article to facilitate loading articles in the carton. Between the highest point and the lowest point along the upper edge of the stopper wall, the upper edge of the stopper wall slopes and curves as necessary to provide the desired accessibility and article retention.

According to another aspect of the present invention, the carton is formed from a blank having a detachable connection comprising one or more frangible lines disposed at one end of the blank for defining the tear panel. In certain embodiments, a first frangible line preferably extends across at least a portion of a first end wall panel hingedly connected to a first side wall, the first frangible line originating on the distal edge and extending to the proximal edge of the first end wall panel. A second frangible line is preferably continuous with the first frangible line, and extends from the proximal edge of the first end wall panel and onto the adjacent first side wall. The second frangible line curves back toward the first end wall panel and terminates at or substantially near the intersection of the first side wall, the top wall, the top wall end flap, and the first end wall panel. A third frangible line extends from the distal edge of a second end wall panel and terminates at the side edge of the second end wall panel that is nearest the top wall end flap.

In certain other embodiments, the first frangible line alternatively extends across at least a portion of the first end wall panel, the first frangible line originating on the side edge of the first end wall panel that is nearest the top wall end flap, and extending across a portion of the first end wall panel to terminate at the proximal edge of the first end wall panel. A second frangible line is preferably continuous with the first frangible line, and extends from the proximal edge of the first end wall panel and onto the adjacent first side wall. The second frangible line curves back toward the first end wall panel and terminates at or substantially near the intersection of the first side wall, the top wall, the top wall end flap, and the first end wall panel.

The foregoing has broadly outlined some of the aspects and features of the present invention, which should be construed to be merely illustrative of various potential applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
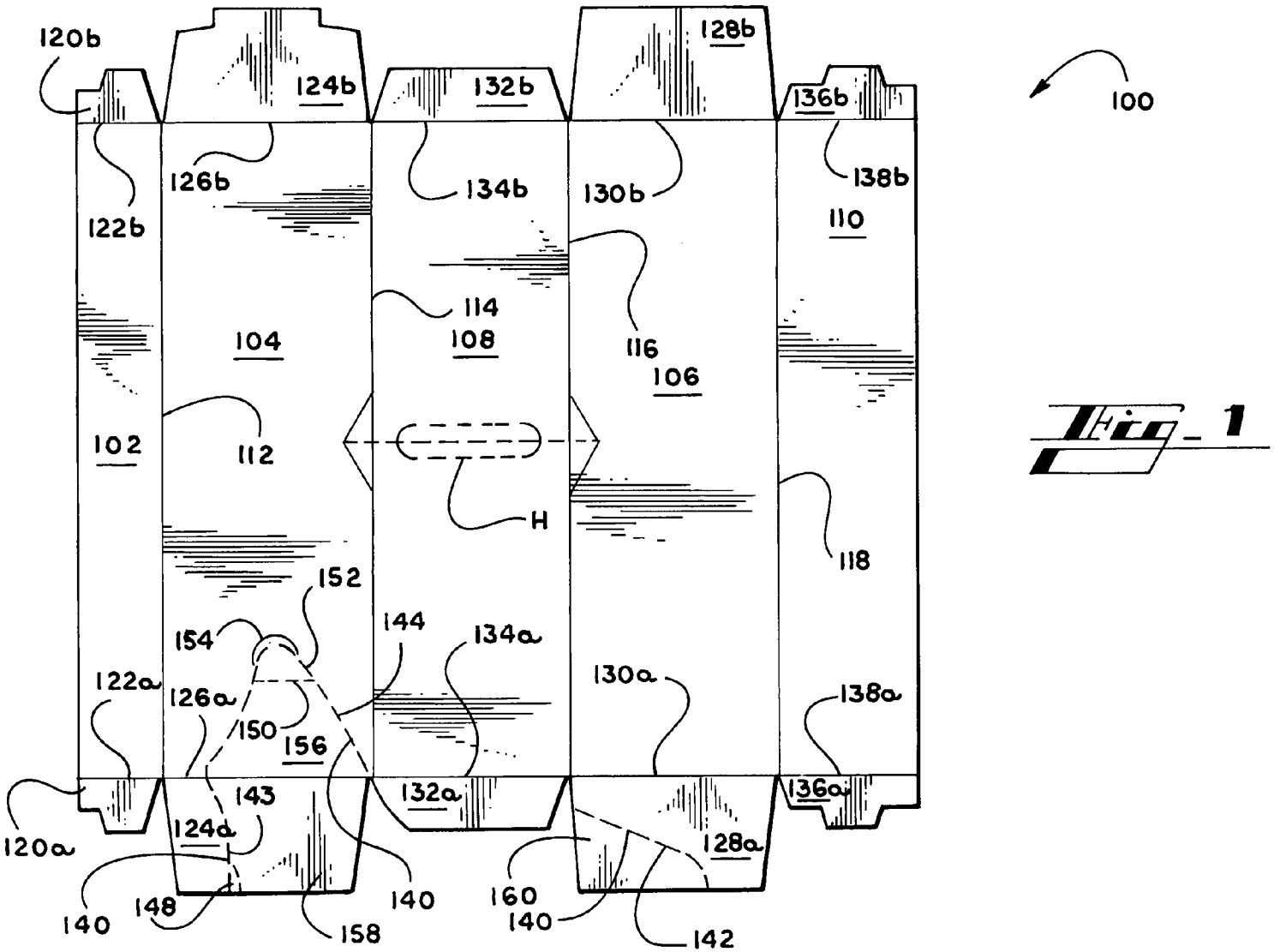
FIG. 1 is a plan view of the exemplary embodiment of a blank for forming a carton of the present invention.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings in which like numerals indicate like elements throughout the several views, the drawings illustrate certain of the various aspects of an exemplary embodiment of a carton according to the present invention. In the embodiments described herein, the carton of the present invention is for enclosing, carrying, and dispensing articles such as beverage cans or bottles. Generally described, the carton is formed from a foldable sheet material such as paperboard, corrugated board, plastic, or the like.

FIG. 1 is a plan view of the exemplary embodiment of a blank for forming a carton 200 (shown in FIGS. 2, 3, 4, and 5) of the present invention. Carton 200 is formed from a paperboard blank 100. The blank 100 includes at least four primary panels for forming the carton 200. The panels of the blank 100 are a first bottom panel 102, a first side panel 104, a second side panel 106, a top panel 108, and a second bottom panel 110. The panels 102, 104, 106, 108, and 110 of the blank 100 are hingedly connected to one another. The bottom panel 102 is hingedly connected to the first side panel 104 by fold line 112. The first side panel 104 is hingedly connected to the top panel 108 by fold line 114. The second side panel 106 is hingedly connected to the top panel 108 by fold line 116. The second bottom panel 110 is hingedly connected to the second side panel 106 by fold line 118. In the illustrated embodiments, a unitary blank is used to form a single carton, although it should be recognized that two or more blanks may be employed, for example, to provide the dispenser structure described in more detail below.

Each of the panels 102, 104, 106, 108, and 110 is hingedly connected to opposing end flaps or end wall panels defined in part by transverse fold lines disposed along opposite edges of the blank 100. When the carton 200 is erected, the end flaps and end wall panels cooperate to form end walls or end closure structures (shown in FIG. 2). In the embodiment illustrated, each end closure structure is sufficiently identical that like references have been used, with "a" or "b" affixed to distinguish one end of the carton from the other. First bottom panel 102 is hingedly connected to end flap 120*a* along a fold line 122*a*. First side panel 104 is hingedly connected to end wall panel 124*a* along fold line 126*a*. Second side panel 106 is hingedly connected to end wall panel 128*a* along fold line 130*a*. Top panel 108 is hingedly connected to end flap 132*a* along fold line 134*a*. Second bottom panel 110 is hingedly connected to end flap 136*a* along fold line 138*a*.

Figure 2:
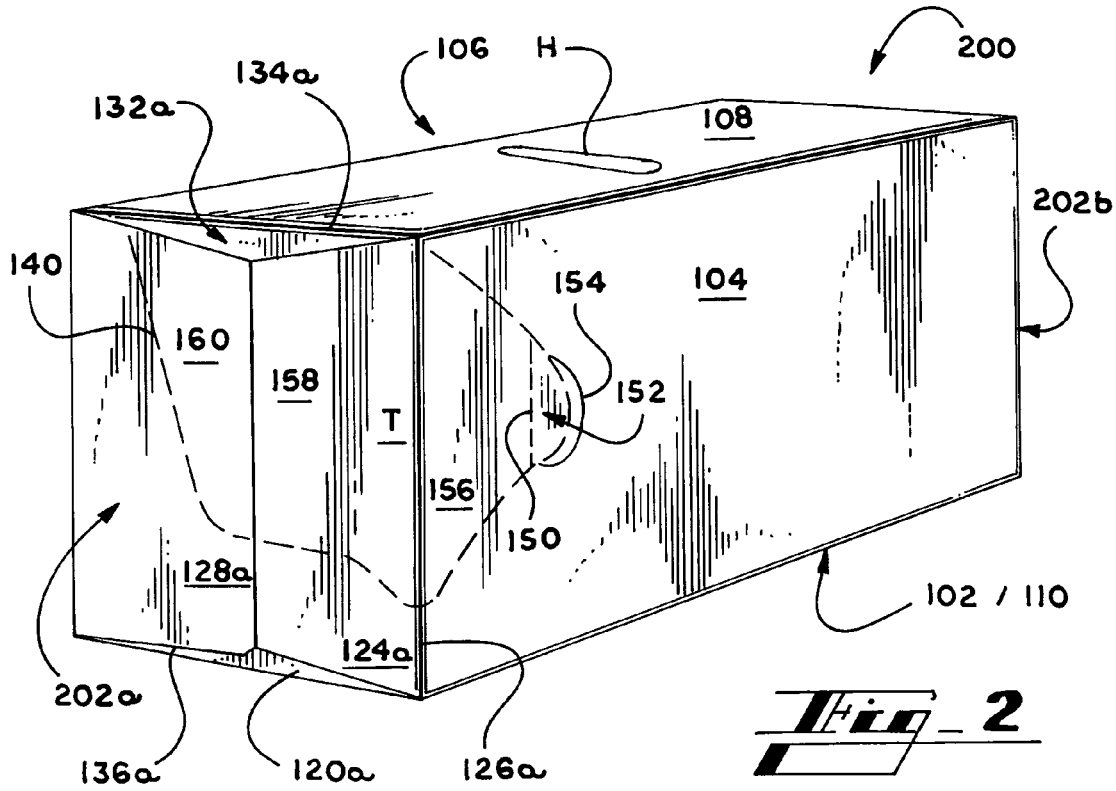
FIG. 2 is a perspective view of the carton formed from the blank of FIG. 1.

FIG. 2 is a perspective view of the carton formed from the blank of FIG. 1. To erect the illustrated carton 200, first bottom panel 102 is glued or is otherwise secured to second bottom panel 110 to form the composite bottom wall 102/110 of open ended tubular carton 200. End flap 120*a* is secured to end flap 136*a* to form a full sized composite end flap 120*a*/136*a*. After the articles are grouped and loaded through either or both of the open ends of the carton 200, the end flaps and end wall panels are folded and secured together to form opposing end closure structures 202*a* and 202*b* of carton 200. In the embodiment shown, end flap 132*a* is folded down but is not fully secured, such that end flap 132*a* is held in position as a result of being in frictional contact with the inside surface of end wall panel 124*a* and secured to end wall panel 128*a* in the erected carton. End wall panel 124*a* is secured to end wall panel 128*a*. In contrast, composite end flap 120*a*/136*a* may optionally support the integrity of the carton by being secured to end wall panel 124*a* and to end wall panel 128*a*. The end flaps 120*b*, 132*b* and 136*b*, and end wall panels 124*b* and 128*b*, cooperate similarly to form the opposing end closure structure. As can be seen in FIG. 2, which shows the carton 200 in a closed condition, the end closure structures are shown as respective end walls 202*a* and 202*b*.

The carton illustrated in the drawings is adapted to hold a group of similarly dimensioned, preferably cylindrical articles such as cans or bottles (shown in FIGS. 4 and 5), in two or more vertically arranged rows. Each tier comprises a horizontally arranged row of articles disposed on sides thereof in a side by side parallel fashion. The tiers are vertically disposed one atop the next. The resultant arrangement approximates a matrix wherein the endmost article in each tier is in an endmost column of articles, the second endmost article in each tier is in a second endmost column of articles, and so forth. The articles in each row are disposed on their sides in a side-by-side parallel fashion. For example, the articles may be enclosed in a 2×6 arrangement comprising a first tier—the lowermost row of six articles, and a second tier—an uppermost row of six articles disposed directly above the lowermost row of articles. In a three tiered arrangement, such as a 3×6, an intermediate row of articles is disposed between the uppermost and lowermost rows described in the forgoing example.

As shown in FIG. 2, side walls 104 and 106 are disposed alongside the ends of the articles of the group, while each end wall 202*a* and 202*b* of the carton is disposed adjacent to the side walls of the respective endmost column of articles.

Figure 3:
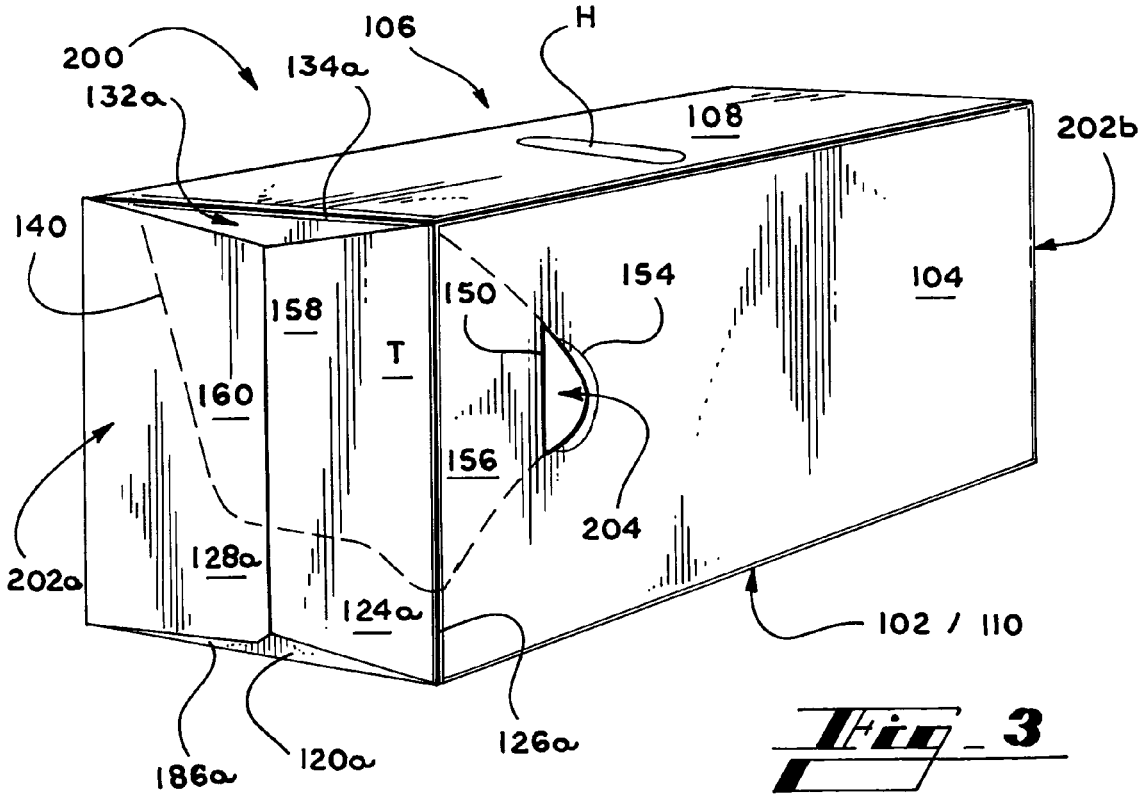
FIG. 3 is a perspective view of the carton of FIG. 2, wherein removal of a detachable tear panel has been initiated by breaking a severance line via a push tab.

As can be seen in FIG. 1, the blank 100 includes a frangible severance line 140 comprising severance lines 142, 143, and 144, which when the carton is erected defines a removable portion of the carton shown as tear panel T in FIGS. 2 and 3. Tear panel T comprises side wall panel section 156 and end wall panel sections 158 and 160. Severance line 142 extends from the distal edge of end wall panel 128*a* and terminates at the side edge of the same end wall panel 128*a* that is nearest to end flap 132*a*. Severance line 143 extends from the distal edge of end wall panel 124*a*, curves slightly toward bottom wall 102, and terminates as it intersects fold line 126*a*. Severance line 144 is preferably continuous to severance line 143, and thus, extends from fold line 126*a* onto side wall 104 where it forms an approximate V shape by extending away from fold line 126*a* and curving relatively sharply back toward fold line 126*a*, terminating at the intersection between fold lines 114, 126*a*, and 134*a*, which forms a corner between side wall 104, top wall 108, and end wall 202*a*. As mentioned above, when the carton is erected, severance line 142, 143, and 144 cooperate to form continuous frangible severance line 140. It is contemplated that the severance line 140 includes, but is not limited to, perforations, a line of perforations, a line of short slits, a line of half cuts, a single half cut, any combination of perforations, slits, and half cuts, short score lines, or the equivalent.

In certain exemplary embodiments, end wall panel 124*a* includes a severance means 148, such as a small slit or cut, that eliminates the need for precise alignment of severance lines 142 and 143 when the carton is folded and erected. The severance means 148 extends for a short distance from the distal edge of end wall panel 124*a* to severance line 143. In these embodiments, the maximum distance between severance means 148 and severance line 143 is at least 0.02 inches and no greater than 0.2 inches, with the preferred distance being approximately 0.13 inches, assuming a standard sized two tier beverage carton. When the carton is erected, end wall panel 124*a* may be positioned in rough alignment with end wall panel 128*a* such that the ends of respective severance lines 143 and 142 need not be aligned exactly to ensure a continuous tearing of frangible line 140.

The blank 100 may also include a suitable known handle H to allow the user to carry the carton.

The blank 100 preferably includes one or more tear or severance initiation means, shown in FIGS. 1 and 2 as the combination of fold line 150, push tab 152, and arcuate score line 154. FIG. 3 is a perspective view of the carton of FIG. 2, wherein removal of a detachable tear panel has been initiated by breaking the severance line 144 via a push tab 152. Fold line 150 and score line 154 function to concentrate pressure onto the portion of severance line 144 that defines push tab 152, such that pressing one or more fingers thereupon causes push tab 152 to collapse into the carton, thereby creating a convenient finger hole 204 that can be used to grasp and remove tear panel T by tearing the remainder of the severance lines 142, 143, and 144 comprising severance line 140. In the embodiment shown, the finger hole is defined by a substantially V-shaped frangible line and by fold line 150, and has dimensions sufficient to allow at least one finger to penetrate the carton 200 upon breaking the section of severance line 144. Those skilled in the art will recognize that various known or yet to be developed tear initiation means can be adapted for implementation in conjunction with the embodiments of the present invention, including but not limited to a push tab, pull tab, flap, loop, any combination of tabs, loops or flaps, or an equivalent structure for gripping a small detached portion of a relatively larger attached structure.

The position of the tear initiation means is preferably in registry with the space between the two endmost articles on the upper row and the two endmost articles on the lower row of the carton 200. This positioning facilitates tear initiation, because the ends of the four endmost articles in the carton support the side wall 104 as pressure is applied to the tear initiation means, thereby encouraging yielding of the side wall 104 only at fold line 150 and score line 154, and thereby concentrating the pressure on the push tab 152 at severance line 140.

Figure 4:
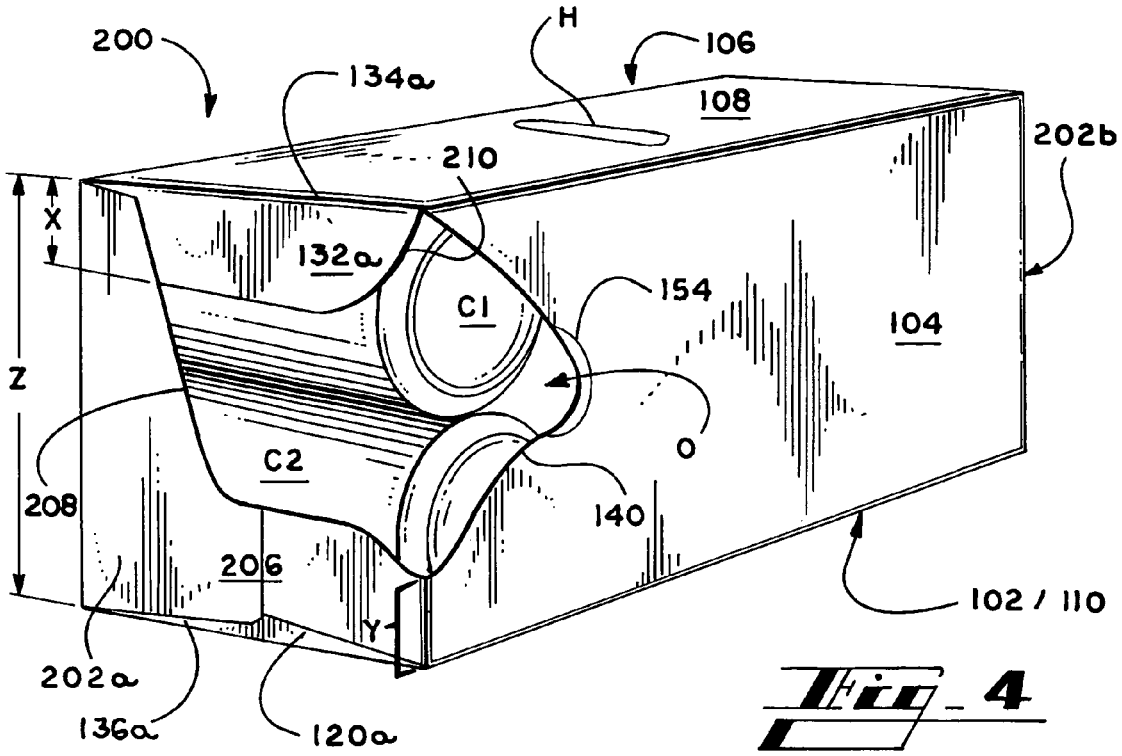
FIG. 4 is a perspective view of the carton of FIG. 2, the carton having been opened by removal of the detachable tear panel.

As best shown in FIGS. 1, 2, and 4, the segment 144 of the severance line 140 that traverses side wall 104, hereinafter referred to as a "side wall severance line," defines a recess 156 that preferably extends substantially toward and then away from end wall 202*b* of the carton 200, such that the recess R is substantially V shaped upon detachment of removable portion T. With reference to FIG. 4, the side wall severance line 144 extends to the connection of the respective side wall 104 with end wall 202*a* at a minimum distance Y above the composite bottom wall 102/110, where Y is less than the diameter of a single article. The lowest point of the recess R is preferably positioned at the corner defined by fold line 126*a* so as to maximize exposure of an end of the endmost article on the lower row, thereby facilitating removal thereof and creating a depression that accommodates the user's thumb as the user removes an article through the access opening O that is formed by removal of tear panel T. The access opening O is preferably sufficiently large to expose at least a portion of the end of the endmost article C1 on the upper row of the carton 200 and the end of the endmost article C2 on the lower row of the carton 200, such that a user can secure a handhold on the end of either article C1 or C2.

The end wall portion of the severance line 140, hereinafter referred to as the "end wall severance line," extends continuously across at least a portion of the end wall 202*a*, from the corner between the side wall 104 and end wall 202*a* as defined by fold line 126*a*, to the edge of top wall 108 as defined by fold line 134*a*. In certain embodiments, the end wall severance line comprises the severance lines 142 and 143, which traverse end wall panels 128*a* and 124*a*, respectively. In these embodiments, severance line 143 extends across at least a portion of an end wall panel 124*a*, which is hingedly connected to a side wall 104, originating on the distal edge and extending to the proximal edge of end wall panel 124*a*. Severance line 142 extends from the distal edge of an end wall panel 128*a* and terminates at the side edge of the end wall panel 128*a* that is nearest end flap 132*a*.

In certain other embodiments, the end wall severance line comprises only an alternative version of severance line 143 (not shown), which traverses end wall panel 124*a*. Alternate severance line 143 extends across at least a portion of end wall panel 124*a* hingedly connected to side wall 104, originating on the side edge of the end wall panel 124*a* that is nearest the end flap 132*a*, and extending at least partially across end wall panel 124*a* to terminate at fold line 126*a*. In the erected carton of these embodiments, end flap 132*a* may be in contact with, but not secured to, the inside surface of end wall panel 128*a*.

FIG. 4 is a perspective view of the carton of FIG. 2, the carton having been opened by removal of the detachable tear panel. Removal of the removable portion T defines a means for retaining articles in the carton 200, the retention means comprising an article stopper wall 206, as well as a stopper flap that comprises end flap 132*a*. End flap 132*a* has a maximum height X that is less than the diameter of one article. The end wall severance line defines the article stopper wall 206 formed primarily from a lower portion of end wall 202*a*, the article stopper wall 206 having an upper edge 208 that is coincident with a portion of severance line 140. Preferably, the minimum height of the stopper wall 206, as defined as the shortest distance Y between the upper edge 208 and the composite bottom wall 102/110, is less than the diameter of one article. The maximum height of the stopper wall 206, as defined as the greatest distance Z between the upper edge 208 of the article stopper wall 206 and the composite bottom wall 102/110 of the carton 200, is substantially equal to the height of the carton 200. End flap 132*a* preferably also has a side edge 210 that curves, bevels, or slants at an angle less than 90 degrees with respect to fold line 134*a*, which enables the user to more easily remove the endmost article from the upper row of the carton. A portion of upper edge 208 of the stopper wall 206 overlaps a portion of end flap 132*a* having a width W, where W is no greater than three quarters of the width of the end wall 202*a* as measured along fold line 134*a*.

Figure 5:
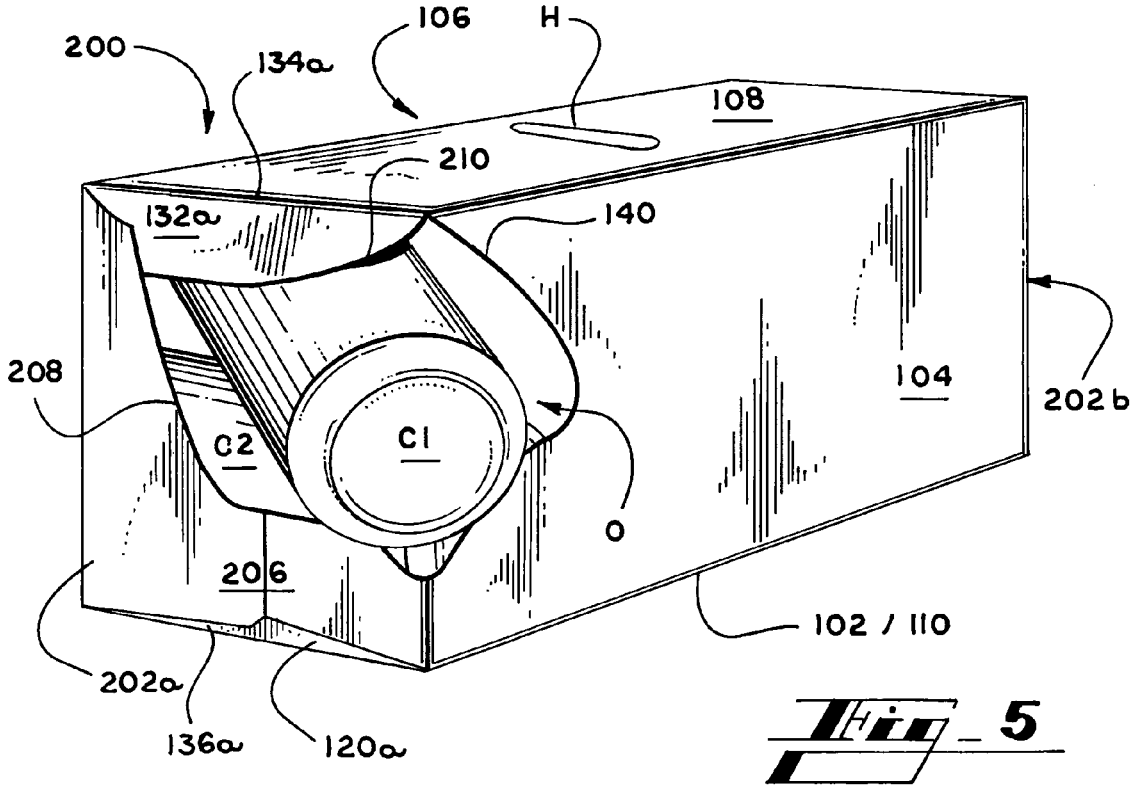
FIG. 5 is a perspective view of a carton of FIG. 2, the carton having been opened by removal of the detachable tear panel, showing the manner of removal of an endmost article from the upper row of the carton.
Figure 6:
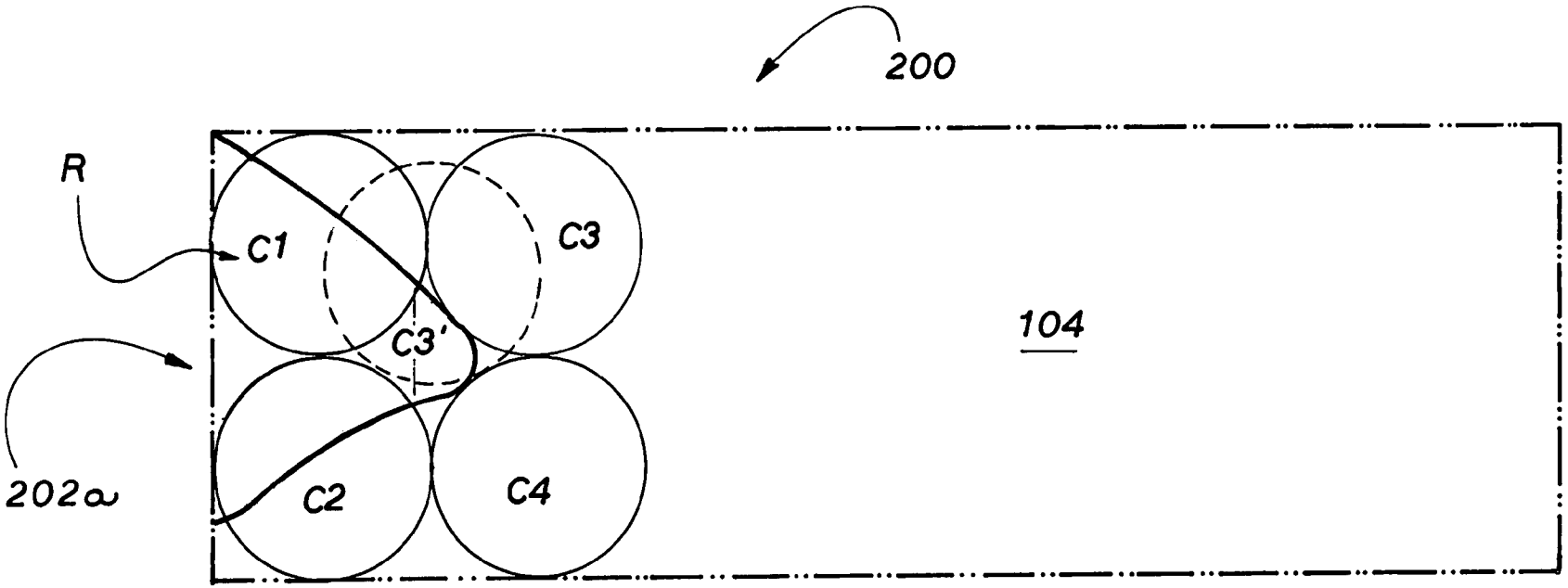
FIG. 6 is a diagram showing the relative positions of the articles in the carton of FIG. 2 before and after the first endmost article has been removed from the upper row.

To remove the first endmost article C1 from the upper row of the carton 200, the user removes tear panel T, as defined by severance line 140, and accesses an end of article C1 via recess R in side wall 104 in order to reposition article C1 for removal from the carton 200. FIG. 5 is a perspective view of the opened carton 200, showing the optimal positioning of endmost article C1 for removal. As shown in the Figure, the user pivots the end of the article C1 at least partially toward the end wall 202*a*, grasping the entire end of the article C1 and pulling the article C1 out of the accessing opening O. FIG. 6 is a diagram showing the change in position of a second article C3 on the upper row of the carton 200 after the first endmost article C1 has been removed from the upper row. As shown in the Figure, article C3' shifts to rest halfway above article C2 and article C4 in the lower row of the carton 200, and thereby exposes itself through the recess R.

After at least some of the articles have been removed from the upper row of the carton 200, the endmost article C2 can be easily removed from the lower row. To remove the first endmost article C2 from the lower row of the carton 200, the user accesses an end of article C2 via recess R in side wall 104 in order to reposition article C2 for removal from the carton 200, pivoting the end of the article C2 upward and at least partially toward the end wall 202*a*, grasping the entire end of the article C2 and pulling the article C2 out of the accessing opening O.

As best shown in FIGS. 2 and 3, carton 200 includes a removable portion T that defines access opening O, which extends across at least a portion of side wall 104 and end wall 202*a* and includes side wall panel section 156 and end wall panel sections 158 and 160. However, it should be understood that the orientation of the elements can be varied according to the needs of the user particularly with respect to configuration of storage and refrigeration units. As an example, depending on the application, the removable portion of a carton may extend across the opposite side and or end walls.

The present invention has been illustrated in relation to a particular embodiment which is intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "inner", "outer", "upper", "middle", "lower", "front" and "rear" do not limit the respective panels or walls to such orientation, but merely serve to distinguish these panels and walls from one another. Any reference to hinged connection should not be construed as necessarily referring to a single fold line only; indeed, it is envisaged that hinged connection can be formed from one or more of one of the following, a score line, a frangible line or a fold line, without departing from the scope of invention. Those skilled in the art will also appreciate that the shapes and sizes of the end flaps and end wall panels are only examples of the various configurations that will be suitable for implementation of the various embodiments of the invention.

It should be understood that various changes may be made within the scope of the present invention, for example, the size and shape of the panels and apertures may be adjusted to accommodate articles of differing size or shape, and alternative end wall structures may be used. The carton may accommodate more than one article in different arrangements, including a group of articles in three or more vertically arranged rows. Although the upper edge 208 of the stopper wall 206 in FIGS. 4 and 5 is shown with an at least partially substantially horizontally extending portion and an at least partially vertically extending portion, the upper edges may have any suitable shape, and for example, may be arched, zigzagged, or creatively shaped, provided that the highest point along such an upper edge in a carton enclosing a group of cylindrical articles has dimensions that conform to the relationships and formulas described above. Accordingly, the scope of the present invention is described by the claims appended hereto and supported by the foregoing.

What is claimed is:

1. A carton, comprising:

a top wall:

a pair of opposed side walls, each defining an upper edge and a lower edge, each connected along a respective one of said upper edges to said top wall;

a stopper flap hingedly connected along an end edge of said top wall;

an end wall hingedly connected to each of said side walls, and cooperatively associated with said stopper flap and said top wall to form a top wall corner extending along the end edge of said top wall; and an article dispenser including an at least partially removable portion defined by a plurality of cooperating severance lines, comprising:

a side wall severance line formed on one of said side walls and extending from said top wall corner to a first point spaced apart from said end wall and to a second point along the hinged connection with said end wall; and an end wall severance line formed on said end wall and extending from said second point toward said top wall corner;

wherein said end wall severance line extends at least partially across said stopper flap such that a portion of said end wall overlaps said stopper flap upon removal of said at least partially removable portion.

2. The carton of claim 1, wherein the width of said overlapping portion is no more than three quarters of the width of said end wall.

3. The carton of claim 1, further comprising a bottom wall interconnecting respective lower edges of said side walls;

wherein the distance between the second point and the bottom wall is no more than half the distance between said first point and said end wall.

4. The carton of claim 1, wherein said stopper flap includes a curved edge adjacent to said second top wall corner.

5. A package, comprising:

a plurality of cylindrical articles each having a cross-sectional width; and a carton with a dispenser for dispensing said cylindrical articles, comprising:

a top wall;

a pair of opposed side walls each defining an upper edge and a lower edge, said side walls being hingedly connected along said upper edges to said top wall;

an end wall hingedly connected to each of said top and side walls to form a first top wall corner and a second top wall corner;

a bottom wall cooperatively attached to each of said end and side walls; and an article dispenser including a stopper wall and a removable portion defined at least in part by a plurality of contiguous severance lines, comprising:

a side wall severance line formed on one of said side walls, extending from said second top wall corner to a first point spaced apart from said end wall to define a length that is at least as great as said cross-sectional width, and extending from said first point to a second point along the hinged connection with said end wall;

an end wall severance line extending across said end wall from said side wall severance line toward said top wall, the minimum distance between said end wall severance line and said bottom wall being no greater than said cross-sectional width; and a stopper flap hingedly connected to said top wall, said stopper flap having a height no greater than said cross-sectional width;

wherein said end wall severance line extends at least partially across said stopper flap such that a portion of said stopper wall overlaps said stopper flap upon removal of said removable portion.

6. The package of claim 5, wherein the width of said overlapping portion of said stopper wall is no more than three quarters of the total width of said end wall.

7. The package of claim 5, wherein:

said articles are arranged in a plurality of rows including an uppermost row and a lowermost row; and said overlapping portion of said stopper wall and said stopper flap cooperate to retain an endmost article in said uppermost row.

8. The package of claim 7, wherein said first point is disposed between four endmost articles on two adjacent rows.

9. The package of claim 7, wherein said side wall severance line defines a side wall recess having sufficient area to expose a portion of an end of the endmost article on said uppermost row and of an end of the end most article on said lowermost row.

10. The package of claim 5, wherein said overlapping portion of said stopper wall and said stopper flap cooperate articulably to variably and reversibly enlarge an opening formed by removal of said removable portion.

11. The package of claim 10, wherein said opening is variably and reversibly enlargeable so as to permit removal of said endmost article in said uppermost row.

12. The package of claim 5, wherein the minimum distance between said end wall severance line and said bottom wall is less than half of said cross-sectional width.

13. The package of claim 5, wherein said stopper flap includes a curved edge adjacent to said second top wall corner.

* * * * *